US005189894A

United States Patent [19]

Buck

[11] Patent Number: 5,189,894

[45] Date of Patent: Mar. 2, 1993

[54] QUICK OPENING, CHILD-SAFE CONTAINER WITH DIGITAL COMBINATION LOCK

[76] Inventor: William M. Buck, 4091 Cypress Reach Ct., Apt. 401, Bldg. 152, Pompano Beach, Fla. 33069

[21] Appl. No.: 833,004

[22] Filed: Feb. 10, 1992

[51] Int. Cl.[5] ..... E05B 65/42; E05B 37/16

[52] U.S. Cl. ..... 70/63; 70/289; 70/298; 70/351; 70/384; 292/DIG. 63

[58] Field of Search ..... 70/57, 58, 63, 286–298, 70/382, 384, 387, 351–352; 292/DIG. 63, DIG. 65; 109/59 R, 38, 61

[56] References Cited

U.S. PATENT DOCUMENTS

| | | | |
|---|---|---|---|
| 596,185 | 12/1897 | Smith . | |
| 690,191 | 12/1901 | Saxe | 70/352 |
| 1,503,565 | 8/1924 | Vives . | |
| 1,608,539 | 11/1926 | Wetherell . | |
| 2,595,267 | 5/1952 | Julliard | 70/387 |
| 2,822,683 | 2/1958 | Kahn | 70/351 X |
| 2,997,872 | 8/1961 | Fry | 70/156 |
| 3,514,981 | 6/1970 | Esquibel | 70/298 |
| 3,821,885 | 7/1974 | Gerry | 70/298 |
| 3,999,792 | 12/1976 | Smith | 292/DIG. 63 X |
| 4,388,815 | 6/1983 | Lawler | 70/387 X |
| 4,768,021 | 8/1988 | Ferraro | 70/63 X |
| 4,790,160 | 12/1988 | Chateau | 70/387 X |
| 4,890,466 | 1/1990 | Cislo | 70/63 |
| 5,070,714 | 12/1991 | Bedford | 292/DIG. 63 X |
| 5,111,755 | 5/1992 | Rouse | 70/63 X |

FOREIGN PATENT DOCUMENTS

| | | | |
|---|---|---|---|
| 326353 | 5/1903 | France | 70/351 |
| 419912 | 4/1947 | Italy | 70/351 |

*Primary Examiner*—Peter M. Cuomo
*Assistant Examiner*—Suzanne L. Dino
*Attorney, Agent, or Firm*—Alvin S. Blum

[57] ABSTRACT

A lock box is provided with a locking cover held locked by a locking element. The lock mechanism is operated by the fingers of a hand actuating individual tumblers, one for each finger, simultaneously. The fingers push against the tumblers and the distance they push them is determined by the length of the fingers which are held by interdigital stops. The tumblers are spring biased against the finger motion. Each tumbler is provided with a stop and pass mechanism that is adjustable along the length of the tumbler to correspond to a particular finger length so that the pass elements of each tumbler will all be aligned to permit passage of the locking element when a particular hand actuates the mechanism, whereas hands of other elements will position at least one of the stop elements so that the locking element cannot pass and the container remains closed.

6 Claims, 1 Drawing Sheet

QUICK OPENING, CHILD-SAFE CONTAINER WITH DIGITAL COMBINATION LOCK

BACKGROUND OF THE INVENTION

This invention relates to security lock boxes, and more particularly to a quick opening box for a handgun that has a combination adjusted to the digit lengths of the user's hand so that it may not be opened by the hand of a child while being quickly opened by inserting the fingers of the hand of the adult to which the locking mechanism has been adjusted.

Many adults find it necessary to keep a handgun in the home for protection. To effectively serve its purpose, it must be available for instant use. Therefore it should be stored loaded and close at hand. A serious drawback to this situation is the danger of accidental shooting by unathorized persons, especially children. Various locking devices such as keys and combination locks for lock boxes and trigger guards are available in the prior art. However, keys may not be close at hand when needed, and combinations take time to operate, especially when in a panic situation and in the dark. Storing the ammunition separately is suggested by safety experts, but this rarely deters children and so delays access as to defeat the purpose for which the handgun was intended.

SUMMARY OF THE INVENTION

It is accordingly an object of the invention to provide a locking closure with a lock mechanism that is not readily defeated or operated by the hand of a yound child, while being quickly opened without a key or manipulation of a combination by a user once the lock mechanism is adjusted to the hand of that particular user.

The container of the invention comprises a closure having a locking, spring loaded latching bolt. Pushing an element with the thumb forces the latching bolt against the spring to unlatch the bolt and unlock the container. Four spring biased sliding tumblers prohibit the free unlatching movement of the latching bolt unless they are aligned in a particular, unlock configuration. Four access holes admit the fingers of the hand to push against the four sliding tumblers. The unlock configuration is adjustable so that the digits of a particular hand, when fully inserted into the access holes will align the sliding tumblers in the unlock configuration so that pressure by the thumb will then move the latching bolt to the open position to unlock the closure to permit access. Operation of the lock box is now exceedingly simple and rapid for the encoded hand. The four fingers are pushed into the access holes and the thumb force releases the bolt. Yet the lock mechanism will not open for a hand with a different pattern of finger lengths and is especially secure against the short fingers of a small child.

These and other objects, advantages and features of the invention will become more apparent when the detailed description is studied in conjunction with the drawings, in which:

DETAILED DESCRIPTION OF PREFERRED EMBODIMENTS

Figure 6:
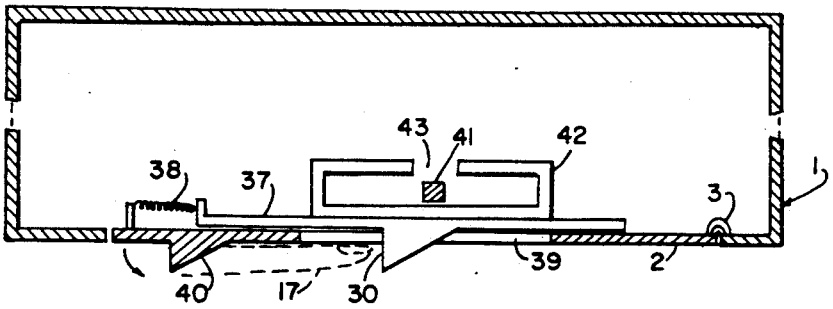
FIG. 6 is a sectional view through an alternative embodiment of the invention with a stationary latching member.
Figure 2:
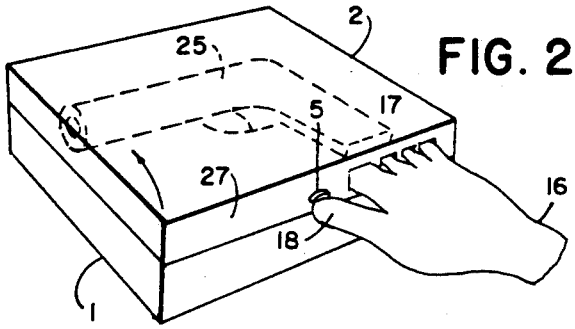
FIG. 2 is a perspective view of the container of FIG. 1 with a hand inserted for unlocking.

Referring now first to FIGS. 1–4, a lock box 1 of the invention is dimensioned for enclosing a handgun 25. It is provided with a hinged closure 2 having hinges 3 that are spring biased to hold the box open when unlocked, so that the unlocking hand may then grasp the gun for single hand use. In a front panel 27 of the closure 2 there are four access ports 4 to receive the fingers 17 of a hand 16. A thumb actuator 5 extends through an aperture 28 in panel 27 and is positioned so that it may be depressed by thumb 18 when the four parallel fingers of the hand are fully inserted into access ports 4. Spacers 23 between access ports limit the depth to which the fingers may be inserted and thereby define the position of the finger tips when the hand is inserted for unlocking operation.

Four tumblers 6 are slidably mounted between spacers 23 and recessed behind the access ports 4 and arranged with a finger tip contact 30 to be engaged by the finger tip 24, for translatory motion as indicated by arrows 32. Compression springs 29 bias the tumblers toward the access ports. Each tumbler 6 is made in two mating portions that may be adjusted for changing the overall length of the tumbler to enable operation by a particular length of finger. A proximal portion 26 is provided with a finger tip contact 30. Its underside is provided with a longitudinal slot (not shown) having vertical striations that match and engage vertical striations 22 on distal portion 31 of the tumbler so that the overall length of each tumbler may be adjusted by setting proximal portion 26 over distal portion 31 at desired length and forcing it downward so the underside slot in 26 is fitted over the striations 22 in distal portion 31 with the mating striations preventing longitudinal movement in the slot. The distal portion 31 of each tumbler has an elongate upper ridge 7 in which is cut a notch 8. A transverse member 13 is slidably mounted for translatory motion orthogonally to the sliding motion of the tumblers and is biased by tension spring 15.

Transverse member 13 is provided with notches 14 arranged so that each tumbler is free to slide, with the upper ridge 7 passing freely through a notch 14. Motion of transverse member 13 in the direction of arrow 33 (FIG. 4) is impeded by the ridges 7 in the tumblers, but is permitted when all the notches or recesses 8 in the tumblers are beneath the transverse member. This will occur when the lengths of the tumblers have been so adjusted to the finger lengths of a particular hand that when those fingers are fully inserted into the access ports the tumblers will be forced slidably against the compression springs to align all the recesses 8 beneath the transverse member 13. When this unlock condition obtains, the transverse member is free to move under the force of a thumb pressed against thumb actuator 5 at the end of latch member 9. Latch member 9 is linked by pivot 21 to pivotal link 19 mounted on closure 2 by pivot 20. Pressure on 5 is transferred to rotary motion of pivotal link 19 that pushes against transverse member 15. Movement of latch member 9 unlatches the closure so that the box may be opened. Latching of the box is provided by the latching element 10 that engages a keeper 11 (FIG. 3) on the box. The latching element 10 has a sloping cam surface 12 that cooperates with the spring loaded keep 11 so that the closure will lock even when the tumblers are misaligned and the latch member is immobilized.

Figure 5:
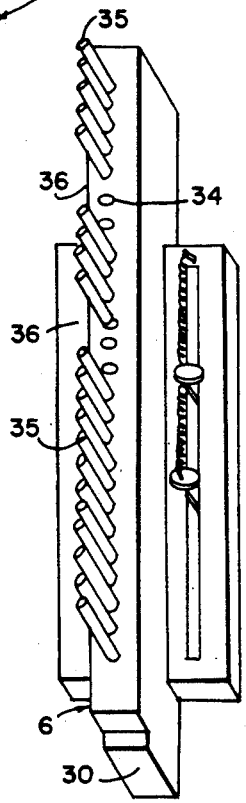
FIG. 5 is a perspective view of an alternative embodiment of a sliding tumbler of the invention.
Figure 1:
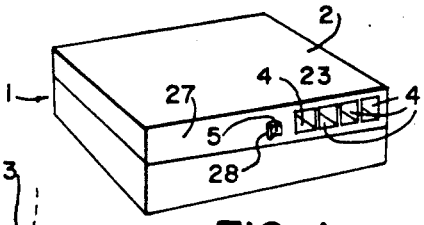
FIG. 1 is a perspective view of a locked container for a handgun according to the invention.
Figure 3:
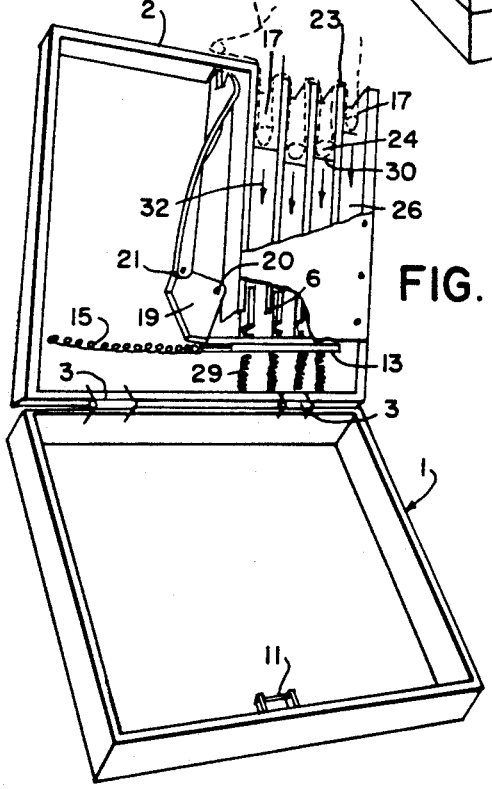
FIG. 3 is a perspective view of the opened box of FIG. 1 with a portion broken away.
Figure 4:
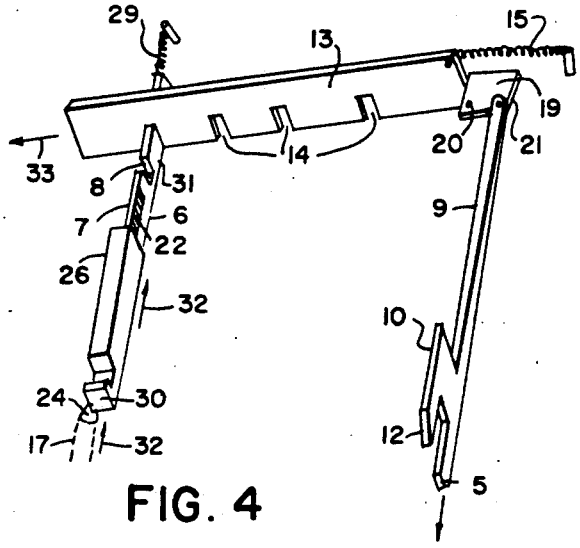
FIG. 4 is a perspective detail of a portion of the lock mechanism of FIG. 3.

FIG. 5 shows an alternative embodiment of a tumbler 6 having finger tip contact 30. The tumbler has a line of holes 34 in its upper surface for removably receiving pins 35. Instead of adjusting the length of the tumbler, the pins are inserted to form the ridge or stop means to prevent movement of the transverse member. And where pins are absent, as at 36, the equivalent of the notch is provided as pass means to permit movement of the transverse member. As shown, there are two notches or pass means 36, so that the lock may be adjusted for two different finger lengths so that two different hands provide the combination to unlock the box.

FIG. 6 illustrates another embodiment of the invention, showing a single one 37 of the four tumblers. The box 1 is closed by closure 2 biased in the open position by spring loaded hinge 3. The tumblers 37 are slidably mounted for translatory motion beneath the cover 2 and biased by tension spring 38. The finger tip contact 30 on tumbler 37 projects through slot 39 in cover 2. Interdigital stops 40 affixed to the cover 2 define the distance that the finger tips can push against the finger tip contacts. An elongate immobile locking bar 41 is fixed at its two ends to the box 1. A stop/pass assembly 42 is mounted upon tumbler 37 and may be adjustably fixed at various points along the length of the tumbler to correspond to a particular finger length so that pass aperture 43 may be aligned with locking bar 41 when the tumbler is pushed by that finger tip to its full extend as limited by stops 40. When all four tumblers are so aligned, the cover 2 will spring open and the hand may then grasp the contents of the box.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

I claim:

1. A quick opening, child safe container for a gun comprising:

A) an enclosure;

B) a closure movably connected to said enclosure, said closure having an open position for access to any contents of said container and a locked position for preventing access to said container;

C) lock means for preventing movement of said closure between said locked position and said open position, said lock means mounted on a first member of a pair consisting of said enclosure and said closure and operatively engaging the second member of said pair in said closed position; said lock means including;

a) a latch member mounted for movement between a latched position in which said latch member engages said second member of said pair to prevent opening of said closure, and an unlatched position, said latch member normally maintained in said latched position by bias means and operable by a human hand having four parallel digits and a thumb;

b) a panel provided with a plurality of digit access ports therein arranged for receiving simultaneously the parallel digits of a hand;

c) thumb actuator means operatively connected to said latch member for moving said latch member from said latched position to said unlatched position by thumb pressure upon said actuator means, said actuator means positioned for actuation by a thumb of a hand while said parallel digits of said hand are inserted in said digit access ports;

d) a plurality of tumbler means, each said tumbler means mounted recessed behind a digit access port and positioned for movement by a finger tip against a spring bias when a digit is inserted in said port, said tumbler means for stopping movement of said latch member when said tumbler means are misaligned and for permitting movement of said latch member when said tumbler means are aligned in a preset configuration; and e) stop means and pass means adjustably mounted upon each said tumbler means, said stop means preventing movement of said latch member when said tumbler means are misaligned, and said pass means enabling said latch member to move freely when said tumbler means are aligned in a preset configuration, said preset configuration being adjusted for the position of said tumbler means when simultaneously engaged by the tips of the parallel digits of said hand when said digits are fully inserted into said digit access ports, whereby said thumb may then move said latch member by force upon said thumb actuator means for quick, secure opening of said container.

2. The container according to claim 1, in which said tumbler means are parallel elongate members having a long axis slidably mounted for translatory motion in a first direction along said long axis, said stop means are projections extending transverse to said long axis and said pass means are recesses in said projections and said digits move said tumbler means along said first direction when inserted into said access ports.

3. The container according to claim 2, in which said lock means further comprises an elongate transverse member operatively connected to said latch member and slidably mounted for translatory motion in a direction transverse to said first direction, said transverse member provided with engagement means for engaging said stop means of said tumbler means when said tumbler means are misaligned to thereby prevent motion of said transverse member and said latch member when said tumbler means are misaligned and for disengaging said stop means when said pass means are aligned to thereby enable said translatory motion of said transverse member and motion of said latch member when said tumbler means are aligned by said finger tips.

4. The container according to claim 3, in which said stop means are adjustable along said long axis of said tumbler means for alignment to a particular set of digit lengths on a particular hand to enable alignment of said pass means and opening of said lock means by said particular hand.

5. A quick opening container with a locking mechanism that is rapidly opened only by a hand to which the locking mechanism has been preset, said hand having a thumb and four parallel fingers with finger tips, said fingers separated from one another by interdigital troughs, in which the length of each finger is defined by the distance from the finger tip to the interdigital troughs adjacent thereto, said container comprising:

A) an enclosure;

B) a closure movably connected to said enclosure, said closure having an open position for access to said container and a closed position for preventing access to said container;

C) a lock mechanism having an unlocked condition for opening said closure and a locked condition to maintain said closure in closed position; said lock mechanism including;

a) a plurality of elongate tumblers each having a long axis, said tumblers slidably mounted parallel to one another on a first member of a pair consisting of said enclosure and said closure for reciprocating, spring biased motion along said long axis, each said tumbler having a finger tip contact element afixed thereto for engagement by a finger tip to provide said motion;

b) a plurality of interdigital stop elements, each stop element affixed to said first member of said pair between adjacent tumblers, said stop elements arranged for engaging said interdigital troughs while the finger tip contact elements are engaged by the finger tips to thereby define the motion of the tumblers by the length of each finger;

c) a locking bar means slidably mounted on one member of said pair and arranged transverse to said long axes for preventing opening of said closure when said lock mechanism is in locked condition;

d) pass means and stop means mounted on each said tumbler and distributed along said long axis in a mutually exclusive manner so that locations along said long axis are provided with one or the other of stop means or pass means, said stop means arranged for operatively interacting with said locking bar means to maintain said locked condition and said pass means not interacting with said locking bar means; and e) adjustment means on each said tumbler for preset adjustment of said lock mechanism for quick opening by a particular hand, said adjustment means providing for adjusting distance between said finger tip contact and said pass means and said stop means so that when the finger tips of said particular hand push the tumblers along said spring biased motion to the extent permitted by said interdigital stop elements, said pass means of all said tumblers will be aligned with said locking bar means to achieve said unlocked condition to permit said closure to be opened, and at least one of said stop means will be aligned with said locking bar means at all other times to achieve said locked condition, whereby said closure is openable only by said particular hand.

6. A quick opening lock mechanism for a chamber having a closure that is rapidly openable only by a hand to which the lock mechanism has been preset, said closure having an open position for access to said chamber and a closed position for preventing access to said chamber, in which the improvement comprises:

a lock mechanism having an unlocked condition for opening said closure and a locked condition to maintain said closure in closed position, said lock mechanism including:

a) a plurality of elongate tumblers each having a long axis, said tumblers slidably mounted parallel to one another on a first member of a pair consisting of said chamber and said closure for reciprocating, spring biased motion along said long axis, each said tumbler having a finger tip contact element afixed thereto for engagement by a finger tip to provide said motion;

b) a plurality of interdigital stop elements each stop element affixed to said first member of said pair between adjacent tumblers;

c) a locking bar means slidably mounted on one member of said pair and arranged transverse to said long axes for preventing opening of said closure when said lock mechanism is in locked condition;

d) pass means and stop means mounted on each said tumbler and distributed along said long axis in a mutually exclusive manner so that locations along said long axis are provided with one or the other of stop means or pass means, said stop means arranged for operatively interacting with said locking bar means to maintain said locked condition and said pass means not interacting with said locking bar means; and e) adjustment means on each said tumbler for preset adjustment of said lock mechanism for quick opening by a particular hand, said adjustment means providing for adjusting the distance between said finger tip contact and said pass means and said stop means so that when the finger tips of said particular hand push the tumblers along said spring biased motion to the extent permitted by said interdigital stop elements, said pass means of all said tumblers will be aligned with said locking bar means to achieve said unlocked condition to permit said closure to be opened, and at least one of said stop means will be aligned with said locking bar means at all other times to achieve said locked condition, whereby said closure is openable only by said particular hand having fingers of particular lengths.

* * * * *